US008754620B2

(12) United States Patent
Bansal et al.

(10) Patent No.: US 8,754,620 B2
(45) Date of Patent: Jun. 17, 2014

(54) VOLTAGE REGULATOR

(75) Inventors: Nitin Bansal, Gurgaon (IN); Kallol Chatterjee, Noida (IN)

(73) Assignee: STMicroelectronics International N.V., Amsterdam (NL)

( * ) Notice: Subject to any disclaimer, the term of this patent is extended or adjusted under 35 U.S.C. 154(b) by 696 days.

(21) Appl. No.: 12/698,328

(22) Filed: Feb. 2, 2010

(65) Prior Publication Data

US 2011/0001458 A1 Jan. 6, 2011

(30) Foreign Application Priority Data

Jul. 3, 2009 (IN) ..... 1375/DEL/2009

(51) Int. Cl.
*G05F 1/00* (2006.01)

(52) U.S. Cl.
USPC ..... 323/273; 323/280

(58) Field of Classification Search
USPC ..... 323/269, 270, 271, 272, 273, 274, 275, 323/311, 312, 313, 314, 280, 281; 327/537, 327/538, 539, 540, 541
See application file for complete search history.

(56) References Cited

U.S. PATENT DOCUMENTS

| | | | | |
|---|---|---|---|---|
| 6,703,815 | B2 * | 3/2004 | Biagi | 323/280 |
| 8,154,263 | B1 * | 4/2012 | Shi et al. | 323/269 |
| 2001/0005129 | A1 * | 6/2001 | Renous | 323/274 |
| 2003/0178978 | A1 * | 9/2003 | Biagi et al. | 323/282 |
| 2007/0194767 | A1 * | 8/2007 | Saitoh | 323/269 |

* cited by examiner

*Primary Examiner* — Nguyen Tran
(74) *Attorney, Agent, or Firm* — Wolf, Greenfield & Sacks, P.C.

(57) ABSTRACT

Described herein are principles for designing and operating a voltage regulator that will function stably and accurately without an external capacitance for all or a wide range of load circuits and characteristics of load circuits. In accordance with some of these principles, a voltage regulator is disclosed having multiple feedback loops, each responding to transients with different speeds, that operate in parallel to adjust an output current of the regulator in response to variations in the output current/voltage due to, for example, variations in a supply voltage and/or variations in a load current. In this way, a voltage regulator can respond quickly to variations in the output current/voltage and can avoid entering an unstable state.

15 Claims, 5 Drawing Sheets

VOLTAGE REGULATOR

RELATED APPLICATIONS

This application claims the priority benefit of Indian provisional patent application number 1375/Del/2009, filed on Jul. 3, 2009, entitled "Capacitorless linear voltage regulator," which is hereby incorporated by reference to the maximum extent allowable by law.

BACKGROUND

1. Field of Invention

The techniques described herein relate generally to voltage regulators. Some embodiments relate to a voltage regulator having a fast transient response and operable over a range of load capacitances. The voltage regulator can operate over a range of load capacitances without an external capacitance to stabilize the regulator. Some embodiments relate to a low-dropout (LDO) voltage regulator operating without a stabilizing external capacitor.

2. Discussion of Related Art

Electronic circuits are often designed to operate using particular supply voltages. A circuit may function improperly when the supply voltage is not at the proper value.

Voltage regulators are used to provide constant supply voltages to circuits despite variations in a power source and/or in the circuit elements. The voltage regulator is connected between a power source and the circuit it supplies. The voltage regulator includes components to regulate a voltage output by the voltage regulator and to monitor that output voltage for the purpose of regulation. The regulator is designed to provide a constant output voltage, but the output voltage of the regulator may vary if there is a variation in the input from the power source and/or if the circuit being powered draws more or less current at a given time (e.g., as the load varies). As the output voltage varies, the regulator operates to compensate for the variation to provide a constant voltage output.

One type of a voltage regulator is a linear voltage regulator, an example of which is shown in FIG. 1. The linear voltage regulator 100 of FIG. 1 operates based on an input supply voltage $V_{in}$ from a voltage source 102 and operates to maintain an output voltage $V_{out}$ at a constant level based on a reference voltage $V_{ref}$. The regulator 100 does this using a voltage-controlled current source 104, producing an output current $I_{out}$ that varies based on variations in $V_{out}$. $I_{out}$ is regulated such that it will yield the desired voltage $V_{out}$, at a constant level. The current $I_{out}$ is also regulated to provide the constant $V_{out}$ based on a level of the input voltage $V_{in}$. The voltage-controlled current source 104 is controlled to ensure that the output current $I_{out}$ appropriately varies as the resistance 106 ($R_{load}$) changes and/or the input voltage $V_{in}$ changes.

To control the current source 104, the regulator 100 includes a resistor network of resistor 110 and resistor 112 that produces a voltage $V_{sense}$ indicative of the voltage $V_{out}$. As $V_{out}$ varies due to a varying current $I_{load}$ drawn by the load circuit on the regulator 100 and/or due to a varying input $V_{in}$, the voltage $V_{sense}$ will also vary. Voltage $V_{sense}$ is input to an error amplifier 108, implemented using an operational amplifier ("op-amp"). The error amplifier 108 compares the voltage $V_{sense}$ to the reference voltage $V_{ref}$ and outputs an error voltage $V_{error}$ indicating a voltage difference between $V_{sense}$ and $V_{ref}$. This voltage $V_{error}$ is then used to control the voltage-controlled current source 104 to output a modified current $I_{out}$ such that the voltage $V_{out}$ is maintained substantially constant.

The variations in $V_{out}$ are known as "transients." A transient is characterized as fast or slow, depending on how quickly the change occurs or how long the change lasts. The period of time from when $V_{out}$ first varies from $V_{ref}$ to the time it settles again to $V_{ref}$—in other words, the time for the regulator 100 to respond to variations in $V_{out}$—is known as the "transient response time." Different types of regulators may have different transient response times. Fast transients may sometimes result in errors in the load circuit if the regulator 100 cannot respond quickly enough to the transient (i.e., if the transient response time of the regulator is slower than the speed of the transient) and the voltage $V_{out}$ varies too much or too long from the constant level expected by the load circuit.

FIG. 2 shows one type of linear voltage regulator, known as a low dropout (LDO) voltage regulator. The drop-out voltage of a regulator is the minimum voltage drop across the regulator needed to maintain the expected output voltage $V_{out}$. A lower drop-out voltage means less energy is consumed by the regulator and thus the regulator has a higher efficiency. An LDO regulator has a low drop-out voltage and can be desirable for many applications that need to conserve energy (e.g., battery-powered devices).

As in the regulator 100 of FIG. 1, the LDO regulator 200 receives an input voltage $V_{in}$ and provides an output voltage $V_{out}$ to a load circuit, and includes a resistor network of resistors 110 and 112 providing a voltage $V_{sense}$ to an error amplifier 108. The voltage-controlled current source of the regulator 200 is implemented using two transistors 202 and 204. The resistor 206 draws a current from the amplifier 108 based on the voltage $V_{error}$, and that current is provided at the base of the transistor 202 to control the current flowing from the collector to the emitter of the transistor 202. The current flowing from the collector to the emitter of transistor 202 is a current drawn on the base of transistor 204, which controls the current flowing from the emitter to the collector of transistor 204. The current flowing from the collector of transistor 204 is output as the output current $I_{out}$ of the regulator 200. The transistors 202 and 204 and the resistor 206 thus act as a voltage-controlled current source that is controlled based on the voltage $V_{error}$, as in regulator 100 of FIG. 1.

Some regulators, particularly the LDO regulator, function properly only for certain types of load circuits that have certain characteristics. For example, the regulators will work properly for load circuits that have a resistance within a certain range, have a capacitance within a certain range, and/or draw a current within a certain range. Outside of those ranges, the feedback loop of the regulator that controls the current source will be unstable. When unstable, the regulator cannot properly regulate the output voltage in responses to transients, and thus the voltage output $V_{out}$ will continue to vary for a long time or indefinitely, causing a large or potentially infinite transient response time. Linear voltage regulators that are used with circuits that change characteristics quickly or to a large degree are particularly susceptible to becoming unstable. If characteristics of a load circuit change quickly as a result of a change in operations in a circuit, then the fast transient may cause the voltage regulator to become unstable and stop working properly. Similarly, a large transient can cause instability in the regulator.

To diminish the risk of this instability occurring and enable the regulators to work accurately with more types of load circuits, regulators (particularly LDO regulators) are used with external capacitances that are coupled to the output of the regulator. The one or more capacitors coupled to the output stabilize the regulator and allow the regulator to operate for more types of load circuits with wider ranges of characteristics.

SUMMARY

In one embodiment, there is provided a circuit arranged as a voltage regulator. The circuit comprises an output terminal to produce an output signal, a first feedback path to monitor the output signal to detect variations in the output signal and to adjust the output signal to compensate for the variations, and a second feedback path to monitor the output signal to detect the variations in the output signal and to adjust the output signal to compensate for the variations. The first feedback path is adapted to compare a level of the output signal to a reference signal identifying a desired level of the output signal. The second feedback path is adapted to respond to the variations in the output signal more quickly than the first feedback path.

In another embodiment, there is provided a circuit comprising an output terminal to produce the output signal for consumption by a load circuit, and a voltage regulator arranged to regulate the output signal to compensate for variations in the output signal resulting at least from variations in the load circuit. A stability of the voltage regulator is independent of a capacitance of the load circuit.

In a further embodiment, there is provided a method of operating a voltage regulator. The method comprises producing an output signal, monitoring, with a first feedback path and a second feedback path, a level of the output signal to detect variations in the output signal. The first feedback path is adapted to compare a level of the output signal to a reference signal identifying a desired level of the output signal. The method further comprises adjusting the output signal, with the first feedback path and the second feedback path, to compensate for the variations. The second feedback path is adapted to respond to variations in the output signal more quickly than the first feedback path.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

As discussed above, to enable conventional voltage regulators to operate stably and accurately for different loads, voltage regulators are typically implemented with one or more capacitors coupled to their output terminal. Applicants have recognized and appreciated, though, that such a modification may not stabilize a regulator or enable it to operate over a suitable load range. Further, Applicants have recognized and appreciated that as capacitors are added to the regulator circuit, the transient time of the regulator grows, which may reduce the regulators' ability to quickly control the output voltage. For regulators that include several capacitors and can operate over a very wide range of load circuits and characteristics, including regulators using Nested Miller Compensation (NMC) techniques, the transient response time can be very high. Regulators with high transient response times may not properly control the voltage output for fast transients, which can cause errors to occur in the load circuit.

Described herein is a voltage regulator that can function stably and accurately for a wide range of load circuits. The voltage regulator may have a stability independent of a load capacitance or load current. Design techniques and operating methods for a voltage regulator are also described. In accordance with some of the principles described herein, a voltage regulator is implemented having multiple feedback loops, each responding to transients with different speeds and different gain amounts. The feedback loops may operate together to adjust an output signal of the regulator in response to variations in the current and/or voltage of the output signal. In this way, a voltage regulator can respond quickly to variations in the output voltage and will not enter an unstable state that will produce an improper output voltage.

In some embodiments, a linear voltage regulator is implemented with two feedback loops that detect variations in an output current/voltage and adjust an output current of the voltage regulator accordingly. One feedback loop may react less quickly to changes in a load current and may have a large gain to make coarse adjustments to an output current. Another feedback loop may react more quickly to changes in the load current and may have a small gain to make fine adjustments to an output current. These two feedback loops can work together to adjust the output current according to both fast and slow transients. Some embodiments may additionally or alternatively incorporate an adaptive biasing scheme to adjust a voltage biasing of components of a regulator in response to transients in the output voltage, as discussed below.

Figure 1:
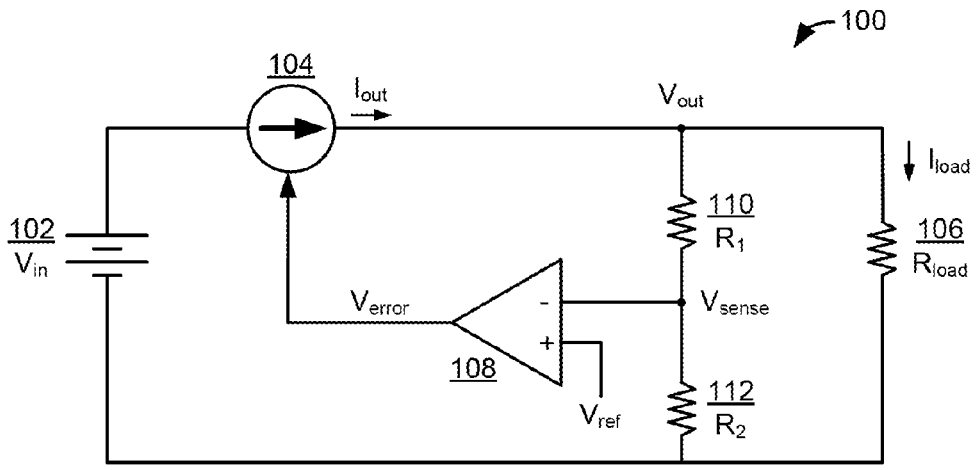
Prior Art FIG. 1
FIG. 1 is a diagram of a conventional linear voltage regulator.
Figure 2:
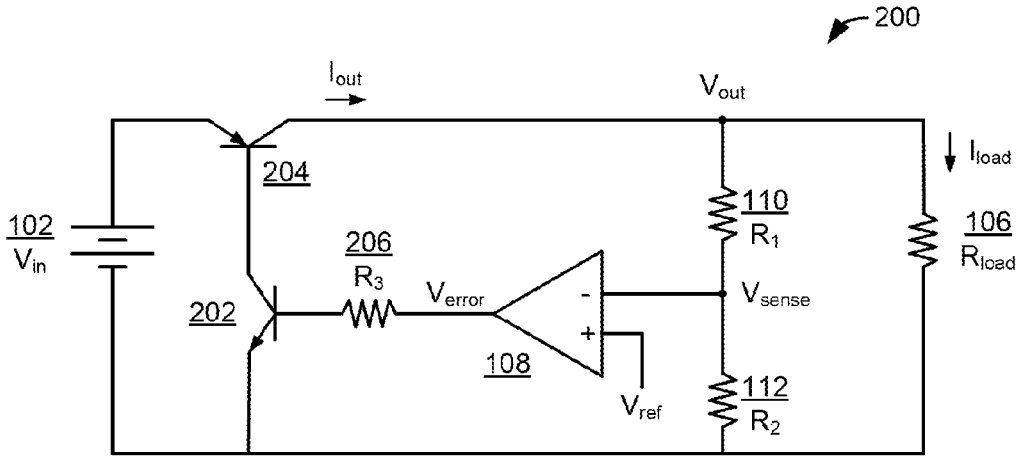
Prior Art FIG. 2
FIG. 2 is a diagram of one type of a conventional linear voltage regulator known as a low-dropout (LDO) voltage regulator.
Figure 3:
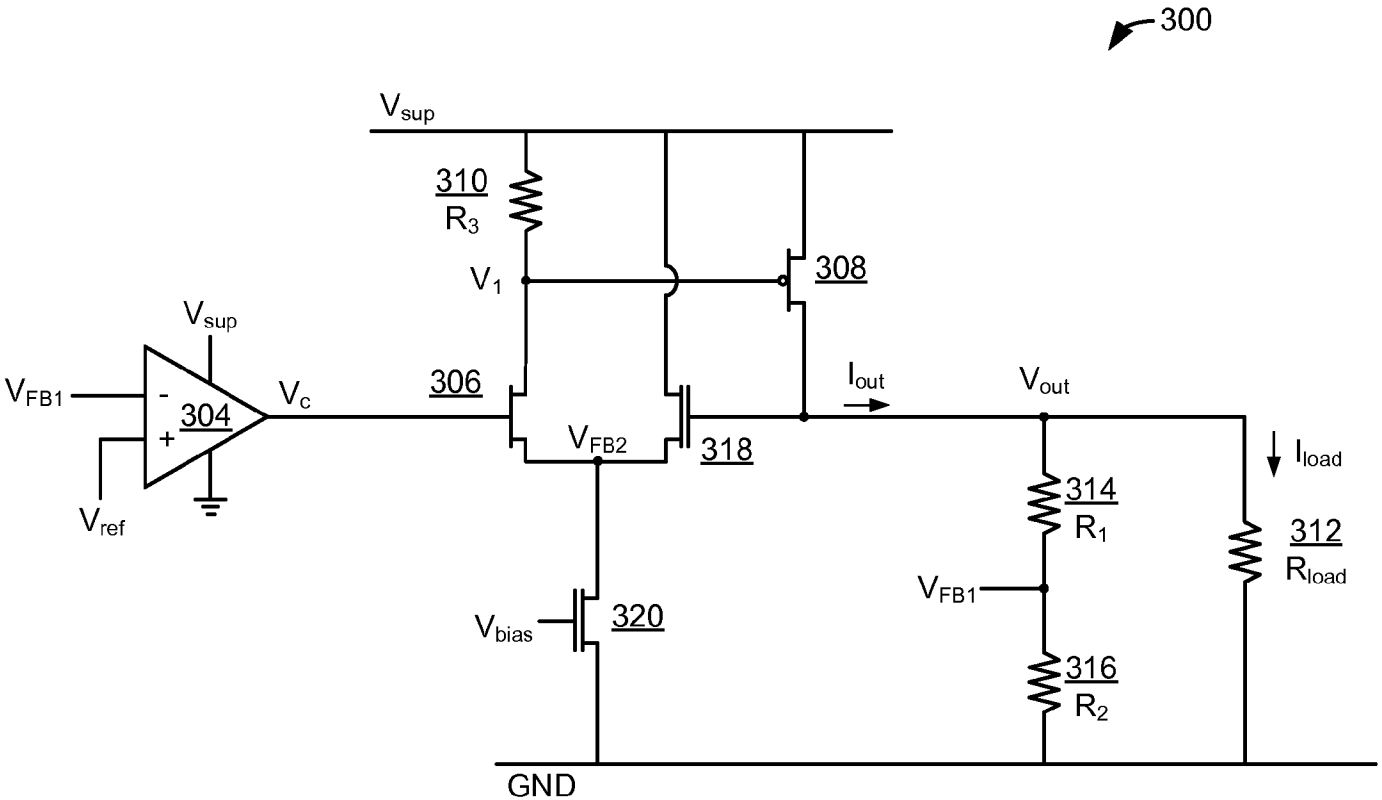
FIG. 3 is a diagram of one voltage regulator operating according to techniques described herein.

FIG. 3 shows one exemplary embodiment of a voltage regulator operating according to some of the principles described herein. The regulator 300 produces an output voltage $V_{out}$ that is provided to a load circuit, shown here as a resistance 312 ($R_{load}$) drawing a current $I_{load}$. The load circuit can be any suitable circuit, as embodiments are not limited to providing power to any particular type of load circuits or load impedance.

The regulator 300 is arranged so as to provide a substantially constant voltage $V_{out}$ for the load circuit by responding to and compensating for transients/variations in the input supply voltage $V_{sup}$ and/or in the current $I_{load}$ drawn by the load circuit. A substantially constant voltage is one in which a voltage stays within desired variation tolerances. For example, a constant voltage may be one that primarily stays within a threshold tolerance for variation and recovers within a desired time period from variations that extend outside the threshold tolerance for variation. These tolerances could be any desired tolerances and may change depending on the application or environment, as the desired voltage output may change between applications and environments.

To provide the substantially constant voltage $V_{out}$, two feedback paths are provided in the regulator 300. In a first feedback path, the regulator 300 monitors the output voltage $V_{out}$ using a resistor network formed of resistor 314 ($R_1$) and resistor 316 ($R_2$). A midpoint node of the resistor network provides a voltage value proportional to the voltage $V_{out}$ (e.g., a voltage value that is half of $V_{out}$). This proportional voltage is labeled as the first feedback voltage $V_{FB1}$.

An error amplifier 304 of the first feedback path is configured to compare the first feedback voltage $V_{FB1}$ to a reference voltage $V_{ref}$ that is related to a desired value of $V_{out}$. Based on this comparison, the amplifier 304 produces an output voltage $V_c$ indicative of a difference between $V_{FB}$ and $V_{ref}$. As $V_{ref}$ is related to a desired level of $V_{out}$, and $V_{FB1}$ is indicative of a current level of $V_{out}$, the voltage $V_c$ also indicates a variation of $V_{out}$ from the desired, substantially constant value.

The voltage $V_c$ is provided at the gate of a transistor 306, acting as an input control voltage to the transistor 306 to adjust the conductivity of the transistor 306. Adjusting the conductivity of the transistor 306 allows for a change in an amount of drain current that flows from the drain to the source through the transistor 306.

Transistor 306 (and other transistors of regulator 300) is implemented to provide a varying amount of drain current. In particular, the drain current ($I_D$) that flows through the transistor 306 is dependent both on the control voltage $V_c$ applied to the gate of the transistor 306 and on a drain-to-source voltage difference ($V_{DS}$). Accordingly, adjusting either or both of the control voltage $V_c$ at the gate of transistor 306 or the drain-to-source voltage difference of the transistor 306 adjusts the drain current. In the regulator 300, the drain-to-source voltage difference is a difference between a voltage $V_1$ (the drain voltage) and voltage $V_{FB2}$ (the source voltage) in the regulator 300 of FIG. 3. Voltage $V_{FB2}$ is discussed in greater detail below.

As the control voltage $V_c$ at the gate of transistor 306 varies according to the difference between $V_{ref}$ and $V_{FB1}$, then, the drain current of the transistor 306 also varies. The drain current that flows through transistor 306, from supply voltage $V_{sup}$ through resistor 310 ($R_3$) and from drain to source through the transistor 306, induces a voltage $V_1$ at a node between the drain of transistor 306 and the resistor 310. This voltage $V_1$ is applied as a control voltage to the gate of a transistor 308 and adjusts the conductivity of transistor 308. The change in conductivity of transistor 308 adjusts the current that is permitted to flow through the transistor 308, which is the output current $I_{out}$ for the regulator 300. This output current $I_{out}$ creates a voltage $V_{out}$ based on the resistance of the load circuit, illustrated in FIG. 3 as resistor 312. This voltage $V_{out}$ is, as discussed above, monitored by the regulator 300 using the resistor network of resistor 314 and 316 to create the first feedback voltage $V_{FB1}$.

Accordingly, in the regulator 300, the first feedback loop comprises the first feedback voltage $V_{FB1}$ that tracks the output voltage $V_{out}$, the error amplifier 304, and the transistor 306 controlled by the output of the error amplifier 304. The components of the first feedback loop, according to changes in $V_{out}$ as indicated by changes in $V_{FB1}$, adjust the conductivity of the transistor 308 and thereby adjust the output current $I_{out}$ and the output voltage $V_{out}$ for the regulator 300, to maintain the voltage $V_{out}$ at a substantially constant level.

As discussed above, the drain current flowing through the transistor 306 is dependent both on the control voltage at the gate and on the drain-to-source voltage difference. The drain-to-source voltage difference is a difference between $V_1$ and second feedback voltage $V_{FB2}$. Accordingly, if the second feedback voltage $V_{FB2}$ were to vary, the drain-to-source voltage difference would also vary.

The second feedback loop operates to adjust the drain current flowing through the transistor 306 by altering the voltage $V_{FB2}$ using the transistor 318. By doing so, the second feedback loop adjusts the voltage $V_1$ and the conductivity of transistor 308, as set forth above, such that the output current $I_{out}$ is adjusted to compensate for variations in $V_{out}$.

The voltage $V_{FB2}$ is dependent on at least three factors. First, a conductivity/resistivity of the transistor 306, which is altered by the control voltage $V_c$. Second, a conductivity/resistivity of the transistor 320, which is adjusted by $V_{bias}$ and may be maintained as a constant during operation of the regulator 300. Third, a conductivity/resistivity of the transistor 318, which is adjusted by the output voltage $V_{out}$. As the conductivity of each of these transistors is adjusted, the current through them varies, which adjusts the voltage $V_{FB2}$. Accordingly, adjusting the conductivity of any of these transistors results in a change in the voltage $V_{FB2}$.

Output voltage $V_{out}$ is provided at the gate of the transistor 318, acting as an input to the transistor 318 to adjust the conductivity of the transistor 318. As voltage $V_{out}$ changes due to, for example, changes in the load resistance $R_{load}$ and/or changes in the supply voltage $V_{sup}$, the conductivity of the transistor 318 will change. As this conductivity changes, the current flowing from supply voltage $V_{sup}$ through the transistor 318 and to the node $V_{FB2}$ will change, which will change the voltage $V_{FB2}$. In this way, through operation of transistor 318 that is gated by the output voltage $V_{out}$, the second feedback voltage $V_{FB2}$ varies according to variations in the output voltage $V_{out}$. The properties of the transistors 318, 320 and the bias voltage $V_{bias}$ can be selected and/or adjusted as desired, such that the second feedback voltage $V_{FB2}$ varies a desired amount with variations in $V_{out}$.

As voltage $V_{FB2}$ changes, the drain-to-source voltage difference across the transistor 306 correspondingly changes, which in turn alters the drain current of transistor 306. As discussed above in connection with the first feedback loop, the change in the drain current changes the voltage $V_1$ that is provided at the gate of the transistor 308. The change in $V_1$ at the gate then alters conductivity of the transistor 308 to alter an output current $L_{out}$. In this way, the second feedback loop comprising the transistor 318, the transistor 320, and the transistor 306 alter the output current $I_{out}$ to maintain the voltage $V_{out}$ at a substantially constant level.

Accordingly, regulator 300 includes two feedback paths: a first feedback path including resistors 314, 316, the error amplifier 304, and the transistor 306; and a second feedback path including the transistor 318, transistor 320, and transistor 306. Both of these feedback paths operate to change a drain current flowing through the transistor 306 to adjust the conductivity of the transistor 308.

The first feedback path is relatively slow as compared to the second feedback path. This is because the operations in the first path of the resistors 314, 316 to determine the first feedback voltage $V_{FB1}$ and the error amplifier 304 to determine the control voltage $V_c$ take a longer time than, in the second feedback path, altering the conductivity of the transistor 318. Because of this, the second feedback path can respond to fast transients (quick or sudden variations in $V_{out}$) better than the slow feedback path.

When $V_{out}$ varies as a result of a transient, the second feedback path may therefore respond first and will alter the conductivity of the transistor 308 to provide more or less output current $I_{out}$ to maintain $V_{out}$ at a substantially constant level. Responding quickly to the transient means that the voltage $V_{out}$ will not deviate from the substantially constant level for a long time and the possibility of errors arising in the load circuit as a result of the variation in $V_{out}$ will be reduced. If the transient lasts a long time, then the first feedback path may also respond to the transient to provide more or less output current $I_{out}$.

While the second feedback path can respond quickly to transients, the second feedback path may be able to respond with less variation in $I_{out}$ than the first feedback path. This is because the drain current through transistor 306 is more dependent on the gate voltage (i.e., the control voltage $V_c$) than on the drain-to-source voltage difference ($V_{DS}$), and thus varies more greatly in response to changes in the gate voltage than to changes in $V_{DS}$. When the second feedback path alters the second feedback voltage $V_{FB2}$, therefore, a change is made in $I_{out}$, but that change is smaller than if the first feedback path alters the control voltage $V_c$ at the gate of the transistor 306. Accordingly, while the second feedback path can respond quickly to transients to provide some change to $I_{out}$ and attempt to maintain $V_{out}$ at a substantially constant level, for large transients (i.e., large variations in $V_{out}$), the slow feedback path will make a greater adjustment to $I_{out}$ and make a larger change to maintain $V_{out}$ at the substantially constant level. In some implementations, the fast feedback loop may respond multiple times to the transient (e.g., adjust the output current $I_{out}$ over multiple cycles) before the slow feedback loop is able to respond. In this way, the fast feedback loop can make multiple fine adjustments to the output current in an attempt to compensate for the transient before the slow feedback loop is able to respond and make a coarse adjustment to compensate.

Together, the first feedback path and the second feedback path of the regulator 300 are able to respond effectively to transients in the voltage $V_{out}$ that are caused by variations in, for example, the supply voltage $V_{sup}$ and/or the power drawn by the load circuit (represented by $R_{load}$). The response of the regulator 300 using the two feedback paths is stable for many types of load circuits and characteristics of load circuits, such that the stability of the regulator is not dependent on the load current or load capacitance being within a certain narrow range of characteristics. Because of this, the regulator 300 may be implemented without a large external capacitance to stabilize the regulator, as is often necessary in conventional regulators. Further, as a result of both the fast second feedback loop and the lack of the external capacitance, the regulator 300 has a low transient response time and can be used with load circuits having fast transients.

The regulator 300 of FIG. 3 also has a low dropout voltage, due to a small number of elements between the supply voltage $V_{sup}$ and the output voltage $V_{out}$—as illustrated in FIG. 3, only the transistor 308 is between $V_{sup}$ and $V_{out}$. The dropout voltage of the regulator 300 is therefore the voltage drop from the drain to the source of the transistor 308, meaning that the regulator 300 can be used in environments that require low power consumption (e.g., battery-powered devices where energy conservation is important) and can be used where the output voltage $V_{out}$ is designed to be very close to the supply voltage $V_{sup}$. The regulator 300 can therefore be used in many environments in which a conventional LDO regulator would be used and without the stabilizing external capacitance that was typically required for an LDO regulator.

As discussed above, as a result of the two feedback loops of the regulator 300, the regulator 300 can respond quickly to variations in $V_{out}$ from any suitable cause. One such cause, as mentioned above, is variations in the supply voltage $V_{sup}$. As a result of the two feedback loops, the regulator 300 has high rejection characteristics for noise and other errant frequency components that lead to variations in the supply voltage. The regulator 300 may therefore be used in environments having potentially noisy power supplies.

It should be appreciated that while the regulator 300 is illustrated in FIG. 3 using specific components, such as MOSFET transistors and operational amplifiers, among others, the regulator 300 can be implemented using any suitable type or types of electrical components. For example, while error amplifier 304 is shown in FIG. 3 configured as an op-amp, but it should be appreciated that any suitable error amplifier may be used. Additionally, transistors 306, 308, 318, and 320 can be implemented as any suitable transistor, including as MOSFET transistors or as any other suitable type of transistor.

Further, transistors may be selected having any suitable material properties, including gates that are insulated or not insulated, and may be implemented in any suitable n-channel or p-channel configuration, as desired. The transistors may be selected to have any suitable voltage drop or range of voltage drops, or range of possible conductivities and currents, as may be required by a particular application or environment. For example, transistor 308 of regulator 300 of FIG. 3 can be selected to provide output currents of all desired magnitudes and/or magnitudes of currents that may be drawn by the load circuit, and can be configured to have a possible voltage drop across the transistor 308 that will yield all desired output voltages $V_{out}$.

It should be further appreciated that the regulator 300 of FIG. 3 is only exemplary of the types of regulators that may be implemented in accordance with techniques described herein that have multiple feedback paths, and that other circuits are possible. Embodiments are not limited to being implemented in the manner illustrated in FIG. 3 or operating as described in connection with FIG. 3.

Figure 4:
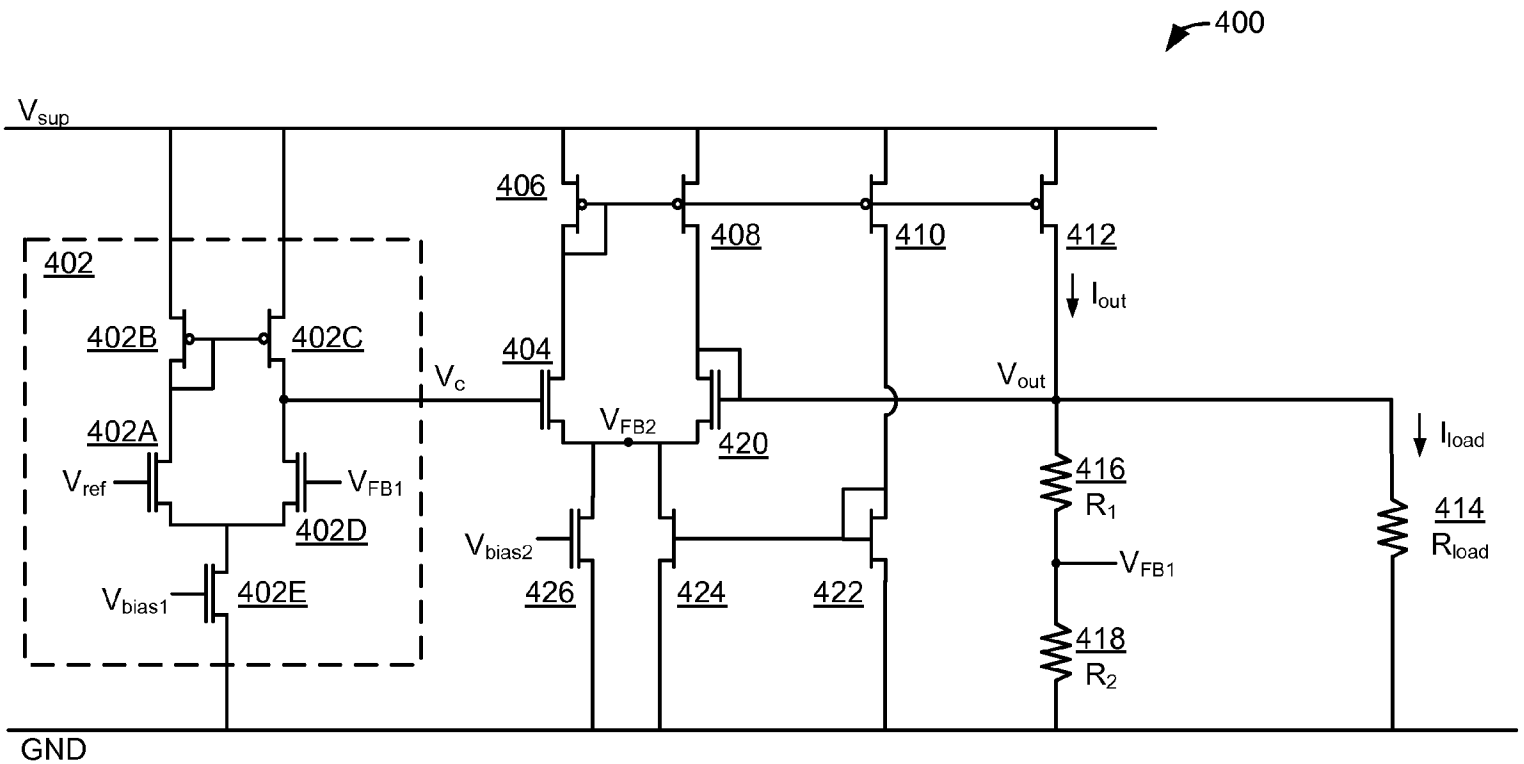
FIG. 4 is a diagram of another voltage regulator operating according to techniques described herein.

FIG. 4 shows one such alternative circuit that may be implemented in accordance with techniques described herein. Regulator 400 of FIG. 4 includes two feedback paths as in the example of FIG. 3, but also illustrates a different type of error amplifier 402 and includes components that adaptively adjust the biasing voltage of the first and second feedback paths, among other differences.

The regulator 400 operates according to a supply voltage $V_{sup}$ to produce an output voltage $V_{out}$ for consumption by a load circuit, represented in FIG. 4 by the resistor 414 ($R_{load}$). The regulator 400 operates to maintain the output voltage $V_{out}$ at a substantially constant level, despite variations in the supply voltage $V_{sup}$ and/or the power drawn by the load circuit. The load circuit can be any suitable load, as embodiments are not limited to providing power to any particular type or types of load circuits.

As in regulator 300 of FIG. 3, the regulator 400 includes an error amplifier 402 that takes as input a first feedback voltage $V_{FB1}$ that is related to a level of the output voltage $V_{out}$. The first feedback voltage $V_{FB1}$ is produced at an intermediate node of a resistor network including resistors 416 ($R_1$) and 418 ($R_2$). The error amplifier accepts first feedback voltage $V_{FB1}$ and a reference voltage $V_{ref}$ and produces as output a control voltage $V_c$ indicative of a difference between $V_{FB1}$ and $V_{ref}$. To produce this output, four transistors 402A, 402B, 402C, and 402D, along with the bias transistor 402E operating according to $V_{bias1}$, are implemented as a resistor network, to provide the control voltage V. The operations of the error amplifier 402 to produce the control voltage $V_c$ will be clear to one of ordinary skill in the art and will therefore not be discussed further herein. As $V_{out}$ varies in response to transients, and $V_{FB1}$ varies correspondingly, the control voltage $V_c$ that is output by the error amplifier 304 will also vary.

The voltage $V_c$ is provided to the gate of the transistor 404 as a control voltage to adjust the conductivity of the transistor 404, as with transistor 306 of FIG. 3. This results in an adjustment of the drain current that flows through the transistor 404. This drain current of transistor 404 is partially dependent on the drain current of a transistor 406 placed between the supply voltage $V_{sup}$ and the transistor 404, as the drain current of transistor 404 will be less than or equal to the drain current of transistor 406.

The source of a transistor 406 is connected to the gate of the transistor 406. As a result, as a voltage at a point between transistors 404 and 406 changes, so does the gate voltage of transistor 406, which also alters the drain current of the transistors 406 and 404.

The gate of transistor 406 is also coupled to the gate of a transistor 412 and is coupled to the gates of transistors 408 and 410. Transistors 408 and 410 will be discussed in greater detail below. As in regulator 300 of FIG. 3, in which the voltage $V_1$ at the gate of transistor 308 is adjusted based on the drain current through transistors 306, the gate voltage on the transistor 412 is adjusted based on the gate voltage of the transistor 406 and the drain currents of transistors 404 and 406.

In this way, as voltage $V_c$ varies, the drain currents of transistors 404 and 406 will vary, and the gate voltages of transistors 406 and 412 will vary.

As the gate voltage of transistor 412 varies, the conductivity of the transistor 412 will change and a drain current of the transistor 412 will change. The drain current of the transistor 412 is the output current $I_{out}$ of the regulator 400. As the output current $I_{out}$ changes, based on the load resistance $R_{load}$ a voltage $V_{out}$ will be induced. As the output current $I_{out}$ varies, the output voltage $V_{out}$ varies.

The first feedback loop comprising the resistors 416 and 418, the error amplifier 402, the transistor 404, and the transistor 406 therefore adjusts the gate voltage of the transistor 412 according to variations in $V_{out}$ as detected by the first feedback voltage $V_{FB1}$. As the gate voltage of transistor 412 changes, the output current $I_{out}$ of the regulator 400 changes to produce a substantially constant output voltage $V_{out}$.

Similar to the second feedback path of the regulator 300 of FIG. 3, a second feedback path comprises a transistor 420 having a gate coupled to the output voltage $V_{out}$. As the output voltage $V_{out}$ varies, the conductivity of the transistor 420 will change and the drain current through the transistor 420 will change. The changing drain current of transistor 420 changes the second feedback voltage $V_{FB2}$. As discussed above with connection to transistor 306 of FIG. 3, a change in the second feedback voltage $V_{FB2}$ changes the drain-to-source voltage difference of the transistor 404, on which the drain current of transistor 404 is dependent. As the voltage $V_{FB2}$ changes in response to changes in $V_{out}$, the drain current through transistor 404 will change, which in turn will adjust the gate voltage at transistor 412 and will change the output current $I_{out}$.

In this way, the second feedback loop comprising the transistor 420, the transistor 426, the transistor 404, and the transistor 406 adjusts the gate voltage of the transistor 412 in response to variations in the output voltage $V_{out}$, such that the output voltage $V_{out}$ can be maintained at a substantially constant level.

As discussed so far, the operations of the first feedback loop and second feedback loop of regulator 400 are similar to the operations of the first feedback loop and second feedback loop of regulator 300 of FIG. 3. The feedback loops of regulator 400 also offer similar benefits to those of the feedback loops of regulator 300. Though, the regulator 400 also includes an adaptive biasing scheme that can be used to adjust the properties of both the first feedback loop and the second feedback loop and can adjust the transient response time of the regulator 400 and improve the accuracy of the regulator 400 in keeping the output voltage $V_{out}$ at a substantially constant rate.

As discussed above, the second feedback voltage $V_{FB2}$ of the regulator 300 of FIG. 3 was dependent on three factors: a conductivity/resistivity of the transistor 306, which was altered by the control voltage $V_c$; a conductivity/resistivity of the transistor 320, which was adjusted by $V_{bias}$; and a conductivity/resistivity of the transistor 318, which was adjusted by the output voltage $V_{out}$.

Voltage $V_{FB2}$ of the regulator 400 is similarly dependent on various factors, including the conductivity of the transistor 404, as altered by the control voltage $V_c$; the conductivity of the transistor 426, as altered by $V_{bias2}$, and the conductivity of the transistor 420, as altered by the output voltage $V_{out}$. As in a resistor network, the voltage of the intermediate node at $V_{FB2}$ is dependent on a resistivity/conductivity of each of these transistors and their relative values. The voltage $V_{FB2}$ is also dependent on other factors.

The voltage $V_{FB2}$ is dependent on a conductivity of the transistor 420, as the drain current of the transistor 420 will adjust the voltage $V_{FB2}$. The drain current of the transistor 420, however, is dependent on a drain current of the transistor 408, as the drain current of transistor 420 will be less than or equal to the drain current of transistor 408. Transistor 408 is coupled between the supply voltage $V_{sup}$ and the transistor 420 with its gate connected to the gate of transistor 406. As discussed above, the gate voltage of transistor 406 is dependent on the drain current of the transistor 404, as altered by the control voltage $V_c$ and the second feedback voltage $V_{FB2}$. The voltage at the gate of the transistor 408 is the same as the voltage at the gate of the transistor 406 and is therefore similarly dependent on the drain current of transistor 404. The conductivity of the transistor 408 and the drain current of transistor 420 that alters the voltage $V_{FB2}$ therefore varies according to the drain current of the transistor 404. As the first and second feedback paths operate to adjust the drain current of the transistor 404, the voltage $V_{FB2}$ will also change due to changes in the transistors 408 and 420. In this way, as the first and second feedback paths adjust $V_c$, $V_{FB2}$, and the drain current through the transistor 404, the biasing of the transistor 404 is also changed. This enables the adaptive biasing of the regulator 400 and the transistor 404 that, as discussed below, enables greater regulation accuracy and lower transient response times for the regulator 400.

A transistor 424 is also coupled to the node of voltage $V_{FB2}$ and adjusts the voltage $V_{FB2}$. The conductivity of the transistor 424 will adjust the voltage $V_{FB2}$ by changing the drain current flowing through the transistor 424 and out of the node $V_{FB2}$. The conductivity of the transistor 424 is dependent on the gate voltage of the transistor 424. The gate of transistor 424, and the transistor 422, is connected to a source of a transistor 410. Accordingly, the drain current and the source voltage of the transistor 410 will adjust the conductivities of transistors 422 and 424, which will in turn adjust the voltage $V_{FB2}$. Just as transistor 408, the drain of transistor 410 is coupled to the supply voltage $V_{sup}$ and the gate of transistor 410 is connected to the gate of transistor 406. The gate voltage of transistor 406, as discussed above, is adjusted based on the drain current of transistor 404, which varies according to control voltage $V_c$ and the second feedback voltage $V_{FB2}$. The conductivity of the transistor 410, then, depends on the voltages $V_c$ and $V_{FB2}$. As the conductivity of the transistor 424 depends on the conductivity of the transistor 410, the transistor 424 also depends on the voltage $V_c$ and $V_{FB2}$ and the operations of the first and second feedback loops that have previously adjusted $V_c$ and $V_{FB2}$ and previously changed the drain current of the transistor 404. Thus, transistors 410, 422, and 424 also form a part of the adaptive biasing scheme of the regulator 400.

Accordingly, with the adaptive biasing scheme shown in FIG. 4, operations of the two feedback loops control the biasing of the transistor 404 by adjusting the "at rest" value of $V_{FB2}$, before the gate voltage of transistor 404 or the gate voltage 420 is changed in the first feedback loop and the second feedback loop, respectively. Controlling $V_{FB2}$ in this manner results in an adjustment in the "at rest" drain current of transistor 404. Because of this, when the first feedback loop or the second feedback loop operate to change the drain current, a smaller change can be made to the drain current and a smaller change made to the gate voltage of transistor 412, such that altering the output current $I_{out}$ as a result of variations in the output voltage $V_{out}$ may be made more quickly. Changing the biasing of the regulator 400 in this way makes the regulator 400 less dependent on the first and second feedback loop for responding to each transient and each variation of the output voltage $V_{out}$, as the biasing of $V_{FB2}$ may be used to respond to the variations/transients.

The adaptive biasing scheme shown in regulator 400 may also be implemented as a third feedback path in the regulator 400, operating based on the signals provided by the feedback paths rather than on the output voltage $V_{out}$. The adaptive biasing scheme may be used as a complement to the other feedback paths or may be used to offset those feedback paths to prevent overshoot in compensation. In the former case, the adaptive biasing scheme may assist the regulator in reaching a desired output level by further adjusting the components and operations of the regulator in response to transients. In the latter case, the adaptive biasing scheme may be used to offset changes made by the first and second feedback path, to prevent the first and second feedback path from making changes that are too great and may overcompensate for a transient, which may lead to oscillations in the output voltage as the regulator compensates one way and then the other. The components of the adaptive biasing scheme (e.g., transistors 408, 410, 422, 424) may be selected such that the biasing scheme responds to variations induced by the first and second feedback paths in a way that compensates for and offsets the variations, so as to dampen the oscillations that could be induced. In this way, the regulator 400 may bring the output voltage back to the substantially constant level more quickly and more accurately.

The adaptive biasing scheme may be slower to react to changes than the slow feedback loop or fast feedback loop of the regulator 400. Accordingly, the adaptive biasing may be useful where the output voltage $V_{out}$ has changed greatly over a long period, and is also changing (with slow and/or fast transients) within that long period. Through operation of the slow feedback loop and the adaptive biasing scheme, the biasing of the voltage $V_{FB2}$ may be altered during the long period to attempt to bring the output voltage back to the substantially constant level, and the first and second feedback loops may also adjust $V_{FB2}$ during the long period in response to the slow and fast transients within the long period.

As discussed above in connection with the regulator 300 of FIG. 3, it should be appreciated that while the regulator 400 is illustrated in FIG. 4 using specific components, such as MOSFET transistors and operational amplifiers, among others, the regulator 400 can be implemented using any suitable type or types of electrical components.

Further, it should be appreciated that the regulator 400 illustrated in FIG. 4 is only illustrative of the types of regulators that may be implemented in accordance with techniques described herein, and that others are possible. Embodiments are not limited to being implemented in the manner illustrated in FIG. 4 or operating as described in connection with FIG. 4.

Additionally, while both the regulator 300 of FIG. 3 and the regulator 400 of FIG. 4 are described as operating with two feedback paths, it should be appreciated that embodiments may operate with any suitable number of feedback paths, including more than two. Further, while the feedback paths of these exemplary embodiments are described as a "slow" feedback path having a high gain and a "fast" feedback path having a high gain, other embodiments may include feedback paths having any suitable characteristics that respond to transients in any suitable manner with any suitable gain. Therefore, other embodiments may not have "fast" and "slow" feedback paths or may have feedback paths that operate differently from the "fast" and "slow" or "low gain" and "high gain" feedback paths.

Figure 5:
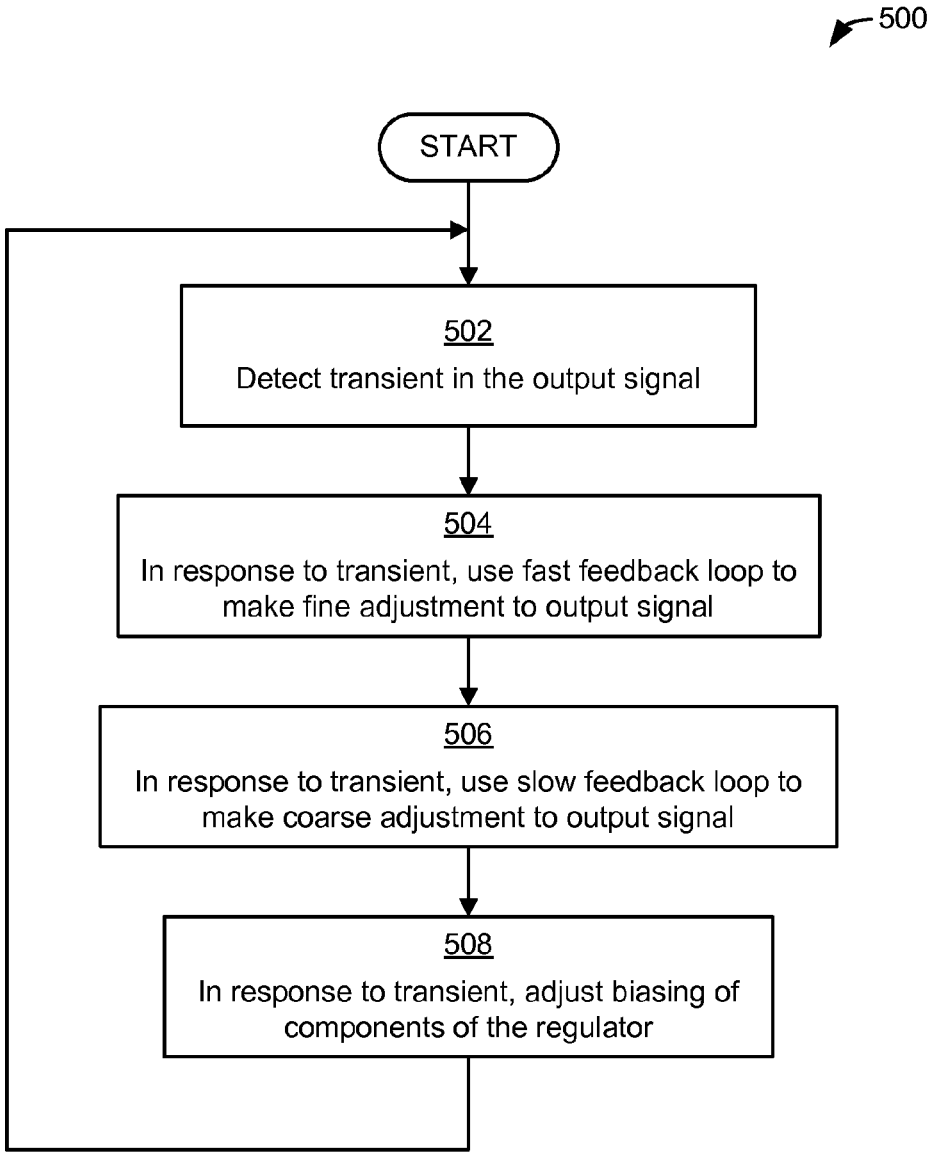
FIG. 5 is a flowchart of one exemplary technique for controlling operations of a voltage regulator in response to transients in an output voltage.

FIG. 5 is a flowchart of one exemplary process for operating a voltage regulator to respond to transients in an output signal being provided to a load circuit. The voltage regulator is arranged to provide a substantially constant output signal and is adapted to respond to transients in such a way as to maintain the output signal at a substantially constant level. The voltage regulator being operated in the process 500 of FIG. 5 includes at least two feedback paths and is able to make both fine and coarse adjustments to the output signal in response to transients.

The process 500 begins in block 502, in which an output signal is being provided to a load circuit and a transient is detected in the output signal. This transient may have arisen for any suitable reason, including as a result of a variation in the load circuit (e.g., the load circuit being switched on, processing new data, etc.), a variation in a supply voltage of the regulator, and/or for other reasons.

In block 504, in response to the transient, a fast feedback loop of the multiple feedback loops is used to make a fine adjustment to the output signal. This fine adjustment by the fast feedback loop quickly makes a small change to the output signal to compensate for the transient. The quick change to the output signal prevents the regulator from entering an unstable state as a result of the transient, and adjusts the output signal quickly such that the load circuit does not receive an improper output signal (e.g., a signal having an incorrect voltage or current) that may cause errors in the load circuit. The fine adjustment quickly made by the fast feedback loop may compensate in a small way for the transient in the output signal, which may be sufficient for the transient. Though, if the transient is large in magnitude (i.e., a large change in the output signal, such as a large change in voltage), then the fine adjustment may be sufficient to prevent an error in the load circuit from immediately occurring, but may not be sufficient to prevent an error in the load circuit from eventually occurring. The change of block 504 is shown in FIG. 5 as occurring once, but the change may occur multiple time over multiple cycles of the fast feedback path.

In block 506, in response to the transient, a slow feedback loop is used to make a coarse adjustment to the output signal. In FIG. 5, block 506 is shown as occurring after block 504, in series. This coarse adjustment may be a large change made to the output signal to compensate for a large transient. Accordingly, following the coarse adjustment, the output signal may be at the substantially constant level desired to be produced by the regulator. It should be appreciated, though, that block 506 could occur at the same time as the actions of block 504 or, in some cases, before the actions of block 504.

In block 508, a biasing of components of the regulator is also changed in response to the transients. Changing the biasing also adjusts the level of the output signal produced by the regulator in a way that is less dependent on the feedback loops, leaving the feedback loops able to respond more quickly and easily to new transients in the output signal.

Following block 508, the process 500 returns to block 502 to detect and compensate for another transient in the output signal.

Figure 6:
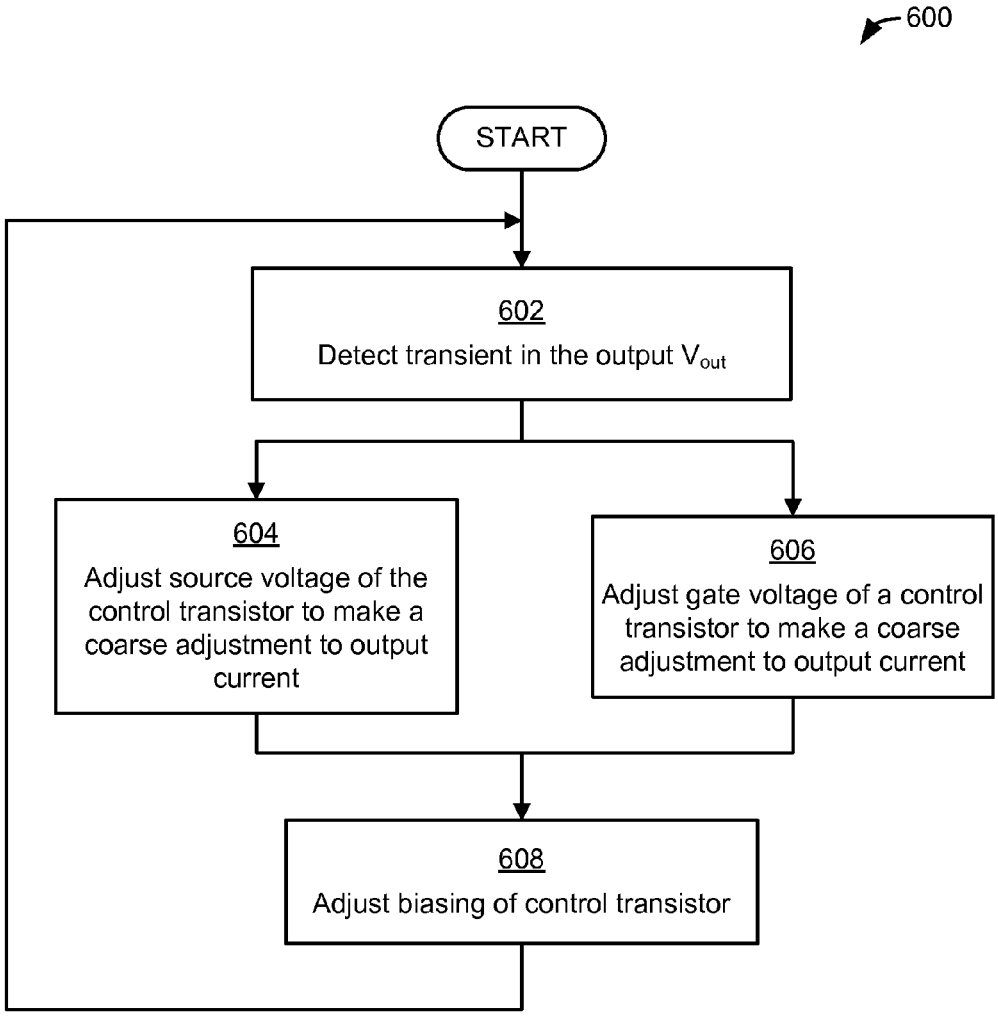
FIG. 6 is a flowchart of another exemplary technique for controlling operations of a voltage regulator in response to transients in an output voltage.

The operations of process 500 may be implemented in any suitable manner on any suitable voltage regulator. FIG. 6 is a flowchart of one particular way for implementing the process 500, though others are possible.

The process 600 is implemented in a particular regulator having two feedback paths that each operate to adjust a drain current through a control transistor of the regulator. The control transistor of the regulator controlled by the process 600 of FIG. 6 controls the state of a pass transistor of the regulator, and the pass transistor produces the output signal of the regulator. The two feedback paths of the regulator operate to make coarse and fine adjustments to an output current of a regulator, such that an output voltage is maintained at a substantially constant level.

The process 600 begins in block 602, in which an output voltage is being provided to a load circuit and a transient is detected in the output voltage, such that the output voltage is deviating from the substantially constant level. The two feedback paths of the regulator then act in parallel to adjust an output current so as to compensate for the transient and maintain the output voltage at the substantially constant level.

In block 604, a fast feedback path of the regulator is used to adjust a source voltage of the control transistor as a result of the transient detected in block 602. Adjusting the source voltage of the control transistor makes a corresponding small adjustment to the drain current of the control transistor. The drain current of the control transistor then effects a change in the output current of the pass transistor of the regulator, which adjusts the output voltage to compensate for the transient.

The fine adjustment quickly made by the fast feedback loop may compensate in a small way for the transient in the output signal, which may be sufficient for the transient. Though, if the transient is large in magnitude (i.e., a large change in the output signal, such as a large change in voltage), then the fine adjustment may be sufficient to prevent an error in the load circuit from immediately occurring, but may not be sufficient to prevent an error in the load circuit from eventually occurring.

Therefore, in block 606, a slow feedback path is used to adjust a gate voltage of the control transistor as a result of the transient detected in block 602. Adjusting the gate voltage of the control transistor makes a corresponding large adjustment to the drain current of the control transistor. The drain current of the control transistor then effects a change in the output current of the pass transistor of the regulator, which adjusts the output voltage to compensate for the transient. This coarse adjustment of the slow feedback path may be a large change made to the output signal to compensate for a large transient. Accordingly, following the coarse adjustment, the output voltage may be at the substantially constant level desired to be produced by the regulator.

In block 606, a biasing of the control transistor may be adjusted as a result of the fine and coarse adjustments made to the output current. Changing the biasing also adjusts the level of the output current produced by the regulator in a way that is less dependent on the feedback loops, leaving the feedback loops able to respond more quickly and easily to new transients in the output voltage.

Following block 608, the process 600 returns to block 602 to detect and compensate for another transient in the output signal.

It should be appreciated that the flowcharts 500 and 600 of FIGS. 5 and 6, respectively, are only illustrative of the various ways in which techniques described herein may be used to operate a voltage regulator. Techniques described herein may be implemented in any suitable way. Accordingly, embodiments are not limited to implementing either of the processes of FIGS. 5 and 6 or operating a voltage regulator according to these processes. Further, it should be appreciated that while the process 500 and 600 are illustrated as including operations taken in a specified order, this order of operations is only illustrative and embodiments may carry out these or any other actions in any suitable order.

Further, while both FIGS. 5 and 6 described making "coarse" and "fine" adjustments using two feedback paths, it should be appreciated that embodiments are not so limited. Coarse and fine adjustments may be made using any suitable feedback paths of a regulator, including two feedback paths, one making a coarse adjustment and one making a fine adjustment, as well as more than two feedback paths that make coarse and fine adjustments in any suitable manner. Further, regulators may operate with feedback paths that make adjustments other than coarse and fine adjustments, and that respond with different speeds to transients in the output voltage, rather than only as "fast" and "slow" feedback paths.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

The invention claimed is:

1. A circuit arranged as a voltage regulator, the circuit comprising:

an output terminal to produce an output signal;

a first feedback path to monitor the output signal to detect variations in the output signal and to adjust the output signal to compensate for the variations, the first feedback path being adapted to compare a level of the output signal to a reference signal identifying a desired level of the output signal;

a second feedback path to monitor the output signal to detect the variations in the output signal and to adjust the output signal to compensate for the variations, the second feedback path being adapted to respond to the variations in the output signal more quickly than the first feedback path;

a pass transistor producing the output signal based on a state of the pass transistor; and a control transistor coupled to the pass transistor to control the state of the pass transistor according to variations in a drain current of the control transistor, wherein the first feedback path adjusts a gate voltage of the control transistor to adjust the drain current of the control transistor, and wherein the second feedback path adjusts a drain-to-source voltage difference of the control transistor to adjust the drain current of the control transistor.

2. The circuit of claim 1, wherein the circuit is arranged such that the stability and/or accuracy of the voltage regulator is independent of the capacitance of the load without requiring a capacitor be connected to the output terminal.

3. The circuit of claim 1, wherein the circuit is arranged to maintain the output signal at a substantially constant voltage, and wherein the first feedback path and second feedback path monitor a voltage of the output signal to detect variations in the voltage of the output signal.

4. The circuit of claim 3, wherein the first feedback path and the second feedback path adjust an output current of the output signal to compensate for the variations in the voltage of the output signal.

5. The circuit of claim 1, wherein the first feedback path is adapted to adjust the output signal by making first changes to a current of the output signal to compensate for the variations in the output signal and the second feedback path is adapted to adjust the output signal by making second changes to the current of the output signal to compensate for the variations in the output signal, wherein the first changes are of a larger magnitude than the second changes.

6. The circuit of claim 1, wherein a drain of the control transistor is coupled to a gate of the pass transistor.

7. The circuit of claim 1, wherein the first feedback path determines a control voltage based on a difference between a voltage of the output signal and a voltage of the reference signal and provides the control voltage to a gate of the control transistor to adjust the drain current of the control transistor.

8. The circuit of claim 7, further comprising:

an error amplifier accepting as input a feedback signal related to the output signal and the reference signal and producing as output the control voltage, wherein the first feedback path includes the error amplifier.

9. The circuit of claim 1, further comprising:

a first transistor having a gate coupled to the output terminal and a source coupled to a source of the control transistor; and a node coupled to the source of the first transistor and the source of the control transistor, a voltage at the node varying according to variations in a conductivity of the control transistor and a conductivity of the first transistor.

10. The circuit of claim 9, wherein the second feedback path includes the first transistor, and wherein the conductivity of the first transistor changes in response to the variations in the output signal.

11. The circuit of claim 1, further comprising:

at least one bias transistor controlling a source voltage of the control transistor based at least in part on operations of the first feedback path and/or the second feedback path.

12. The circuit of claim 11, wherein a conductivity of the at least one bias transistor is dependent on the drain current of the control transistor.

13. The circuit of claim 1, wherein the first feedback path adjusts the output signal by making a first change in a magnitude of the output signal in response to variations in the output signal, wherein the second feedback path adjusts the output signal by making a second change in the magnitude of the output signal in response to the variations in the output signal, and wherein the first change in the magnitude is a greater change in the magnitude than the first change.

14. The circuit of claim 13, wherein making the first change in the magnitude of the output signal comprises making a first change in a magnitude of a current of the output signal and making the second change in the magnitude of the output signal comprises making a second change in the magnitude of a current of the output signal.

15. The circuit of claim 1, wherein the voltage regulator is a low dropout (LDO) voltage regulator.

* * * * *